US005142307A

United States Patent [19]

Elrod et al.

[11] Patent Number: 5,142,307

[45] Date of Patent: Aug. 25, 1992

[54] VARIABLE ORIFICE CAPILLARY WAVE PRINTER

[75] Inventors: Scott A. Elrod, Palo Alto; Calvin F. Quate, Stanford, both of Calif.

[73] Assignee: Xerox Corporation, Stamford, Conn.

[21] Appl. No.: 634,274

[22] Filed: Dec. 26, 1990

[51] Int. Cl.[5] ..... B41J 2/045

[52] U.S. Cl. ..... 346/140 R; 310/311

[58] Field of Search ..... 346/140 R; 310/317, 310/313 R, 313 A, 322, 323, 330, 334

[56] References Cited

U.S. PATENT DOCUMENTS

| | | | |
|---|---|---|---|
| 4,275,290 | 6/1981 | Cielo et al. | 219/216 |
| 4,513,299 | 4/1985 | Lee et al. | 346/140 R |
| 4,521,786 | 6/1985 | Bain | 346/140 R |
| 4,593,291 | 6/1986 | Howkins | 346/1.1 |
| 4,719,476 | 1/1988 | Elrod et al. | 346/140 R |
| 4,719,480 | 1/1988 | Elrod et al. | 346/140 R |
| 4,748,461 | 5/1988 | Elrod | 346/140 R |

*Primary Examiner*—Benjamin R. Fuller
*Assistant Examiner*—Victor DeVito
*Attorney, Agent, or Firm*—Anglin & Giaccherini

[57] ABSTRACT

An apparatus and methods for using a Variable Orifice Capillary Wave Printer are disclosed. The invention as described herein provides a capability to transfer high resolution graphical images onto a projection medium (14) with pseudo-gray-scale (i.e. variable spot-size). A standing fluid ripple wave (38) or capillary wave is generated along a narrow channel (20) at the top of an ink reservoir (16), upon the free fluid surface (27). The capillary wave (38) is spatially stablized with an elongated slotted bar (30) of anisotropically etched signal crystal silicon. Piezoelectric pushers (34) are positioned at the anti-nodes (42) of the stabilized standing capillary wave (38) to selectively restrict the narrow slots (32) etched into the slotted silicon bar (30). Selective actuation of one or more piezoelectric pusher (34) for a predetermined length of time results in the ejection of a stream of fluid droplets (12). Pseudo-gray-scale printing is achieved by independently varying the ejction period of each piezoelectric pusher (34). A low-cost, highly integrated and highly producible apparatus (10) may be created by laminating an array of selective transistor switches (**36*a*) and an array of piezoelectric pushers (34) onto a glass substrate (36*b*) which is embedded in the body of the acoustic ink reservoir (16). The shortcomings of current apparatus designed for selectively addressing the anti-nodes (42) of a stabilized standing capillary wave (38**) have been overcome by the Variable Orifice Capillary Wave Printer, making such a device a low-cost and highly producible alternative for the printer industry.

13 Claims, 7 Drawing Sheets

VARIABLE ORIFICE CAPILLARY WAVE PRINTER

BACKGROUND OF THE INVENTION

The present invention is a method and apparatus that pertain to printing systems. More particularly, this invention provides a capillary wave printer that accurately delivers a high density, variable intensity pattern of ink droplets onto a projection surface at very high speeds.

A printer is a device which transfers information, either graphics or text, from a computer medium to hardcopy, such as paper. The speed at which the paper hardcopy may be produced, the clarity and the resolution of the hardcopy are measures of the quality of the printer. Resolution is a measure of the capability of a printer to reproduce fine detail on paper. The higher the resolution of the printer, the more faithful the reproduction of the original text or graphics and the more impressive the final product. The technology utilized determines the quality of the printer and its ultimate cost.

The use of capillary surface waves (i.e., those waves which travel on the surface of a liquid in a regime where the surface tension of the liquid is such a dominating factor that gravitational forces have negligible effect on the wave behavior) are attractive for liquid ink printing and are known to persons ordinarily skilled in the electronic printing arts (e.g. U.S. Pat. No. 4,719,476 entitled "Spatially Addressing Capillary Wave Droplet Ejectors and the Like", and U.S. Pat. No. 4,719,480 entitled "Spatial Stabilization of Standing Capillary Surface Waves"). The spatial frequency range in which capillary waves exist spans and extends well beyond the range of resolutions within which non-impact printers normally operate. The method of selectively addressing individual wave crests of standing capillary surface waves to eject droplets from the selected crests on command is well-known to persons ordinarily skilled in the electronic printing arts. To this end, the addressing mechanims locally alter the surface properties of the selected wave crests, such as the local surface pressure acting on the selected crests and/or the local surface tension of the liquid within the selected crests. Discrete addressing mechanisms are especially attractive for printing, not only because their individual addressing elements may be spatially fixed with respect to one dimension of the recording medium, but also because the spatial frequency of their addressing elements may be matched to the spatial frequency of the capillary wave. Such spatial frequency matching enables selected crests of the capillary wave to be addressed in parallel, thereby allowing droplets to be ejected in a controlled manner from the selected crests substantially simultaneously, such as for line printing.

The problem of printing high resolution graphical images very quickly and with faithful gray-scale rendition has presented a major challenge to the printer industry. The transfer of high resolution black and white graphic images from a computer screen to hardcopy requires that each picture element, or pixel, in the computer memory be faithfully reproduced in true relative intensity. True relative intensity is expressed in shades of gray which is a continuous scale of brightness between a minimum black level and a maximum white level. Most printers produce "half-tone" images rather than true shades of gray. A half-tone image is a spatial arrangement of black and white "dots" which creates a graphics image on a computer screen or on paper. Half-tone images are easy to create since only black and white "dots" are required, however, the resultant image is lacking in resolution and clarity when compared to a black and white photograph for example.

Since many computers now have video graphics capability, whereby each pixel on the screen is assigned its own unique shade of gray falling somewhere between black and white, full resolution photographic quality images are available to the computer user. Printing a hardcopy of what is seen on the computer display (which contains multiple shades of gray) is however not possible with today's binary pixel printers (i.e., black and white, no gray-scale). A compromise approach which falls short of true multi-level gray-scale printing, but which offers image quality superior to that of fixed spot size half-tone printing, is the variable spot size, pseudo-gray-scale printing technique.

If a printer were able to effectively produce high quality, pseudo-gray-scale images at an affordable price, then such a printer would be in very high demand by consumers. The development of a straightforward method and apparatus which would provide the capability to print high resolution images with pseudo-gray-scale or full color at significantly faster rates would represent a major technological advance to the printer industry.

Though capillary wave droplet ejectors are known in the prior art, no printers utilizing this technology exist on the market today. One of the reasons for this is the lack of a cost effective line printer head which provides for the selective addressing of capillary wave peaks under computer control. Some prior devices utilize an array of discrete addressing electrodes which may be pulsed with short pulses of moderately high voltage electrical energy (coherent with the frequency of the capillary wave) to permit the parallel addressing of selected wave crests. Other earlier devices employ a print head utilizing discrete electrical or thermal addressing elements supported on a suitable substrate, such as a Mylar film, and mounted in a transverse orientation slightly below the free surface of the ink. All current apparatus for selectively addressing capillary wave peaks have shortcomings making them impractical for the marketplace. First of all, thermal addressing mechanisms have too long a time constant, thus limiting the maximum throughput rate achievable. Laser addressing mechanisms require precise opto-mechanical alignments which are complex and costly. And finally, the selective generation of E-fields to destabilize capillary wave peaks creates electro-chemical interactions with the ink supply. Clearly, a highly producible discrete addressing mechanism for a capillary wave printer head which surpasses the current state-of-the-art would enable the variable spot size capillary wave printing technology to advance in the marketplace. The enhanced performance and low-cost print heads which could be produced using such innovative technology would satisfy a long felt need within the printing industry.

SUMMARY OF THE INVENTION

The Variable Orifice Capillary Wave Printer is a method and apparatus that provide a capability to transfer high resolution graphical images having variable spot-size pseudo-gray-scale or color, onto a projection surface at very high speeds. In the present invention a standing fluid ripple wave along a narrow channel at the top of a fluid container is generated through the oscillating action of an electro-acoustic transducer, positioned at the bottom of the fluid container. The fluid wave peaks are spatially stabilized along a transverse axis by positioning a slotted bar of silicon having periodically spaced slots within the narrow channel. Piezoelectric devices positioned at the top of each slot opening may be stimulated by an electric field to independently narrow each slot opening. When a slot opening is briefly narrowed, the pressure at the oscillating surface increases above the threshold which overcomes the surface tension of the liquid, and a stream of fluid droplets is ejected from the corresponding capillary wave crest. Pseudo-gray-scale rendition of a graphical image may be accomplished by maintaining the narrowed slot for a predetermined period of time, thus controlling the number of fluid droplets within each stream as a function of spatial orientation upon the projection surface. The Variable Orifice Capillary Wave Printer breaks through the limitations to cost effective, high resolution and high speed printing which is present in the current state-of-the-art.

An appreciation of other aims and objectives of the present invention and a more complete and comprehensive understanding of this invention may be achieved by studying the following description of a preferred embodiment and by referring to the accompanying drawings.

DETAILED DESCRIPTION OF A PREFERRED EMBODIMENT

Figure 1:
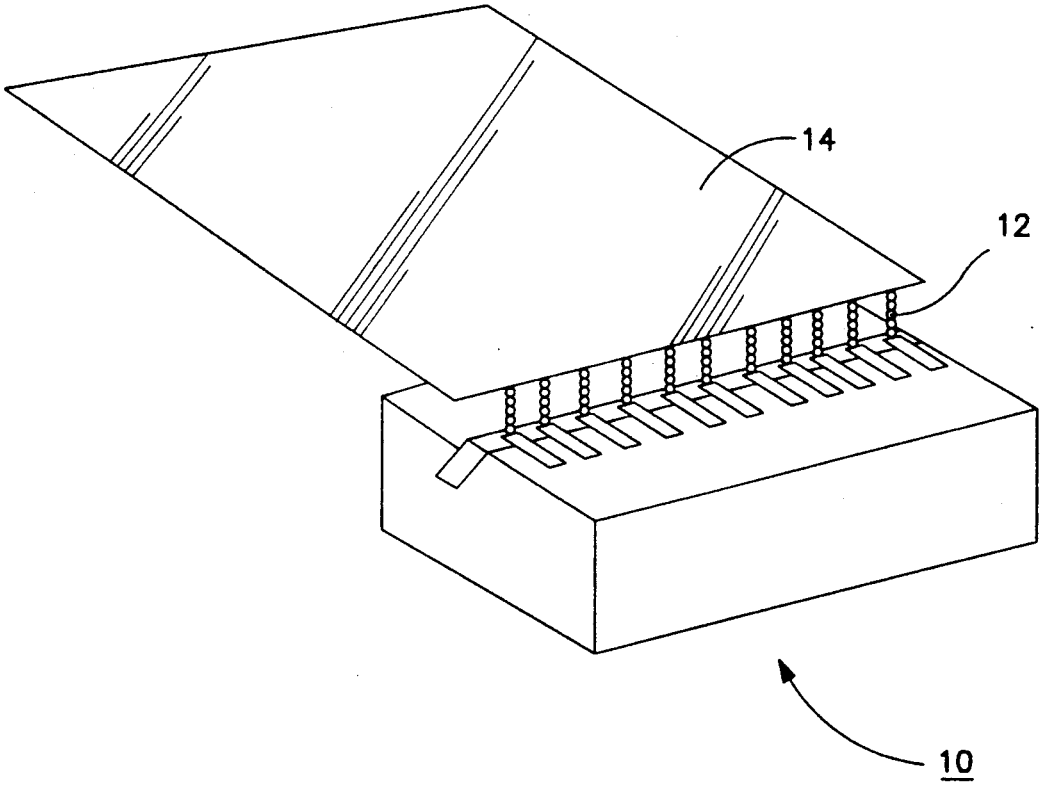
FIG. 1 is a perspective view of the present invention, the Variable Orifice Capillary Wave Printer.

FIG. 1 is a perspective view of the present invention, the Variable Orifice Capillary Wave Printer 10. Streams of fluid droplets 12 are ejected from an aqueous or an oil based pool of ink (not shown) onto a projection surface 14, such as paper, as the projection surface 14 is moved across the print head 10. In a preferred embodiment, the present invention 10, a line printer, is conveniently sized to match the width of the projection surface 14 so that only one pass is required to complete a printing process. An ink having a high cavitation threshold (or de-gassed prior to use) is utilized.

Figure 2:
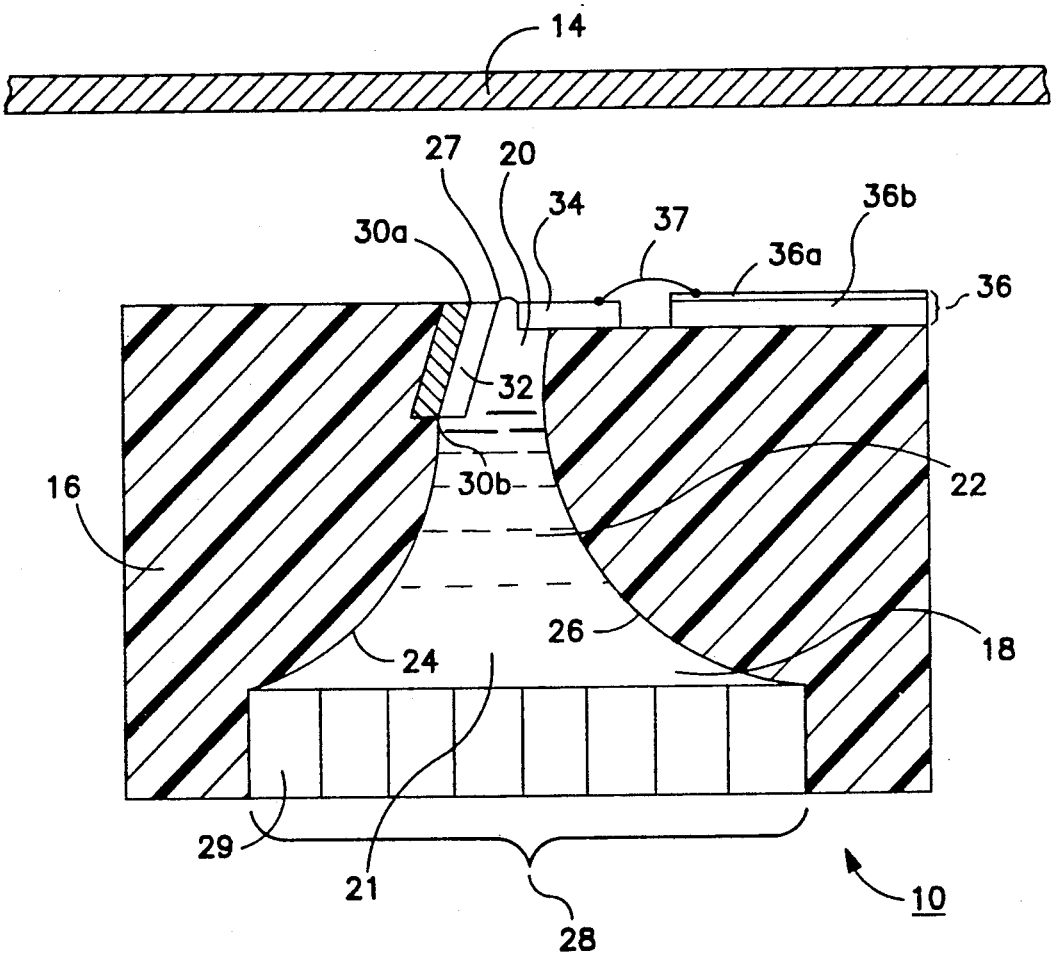
FIG. 2 is a sectional view of the apparatus illustrated in FIG. 1.
Figure 3:
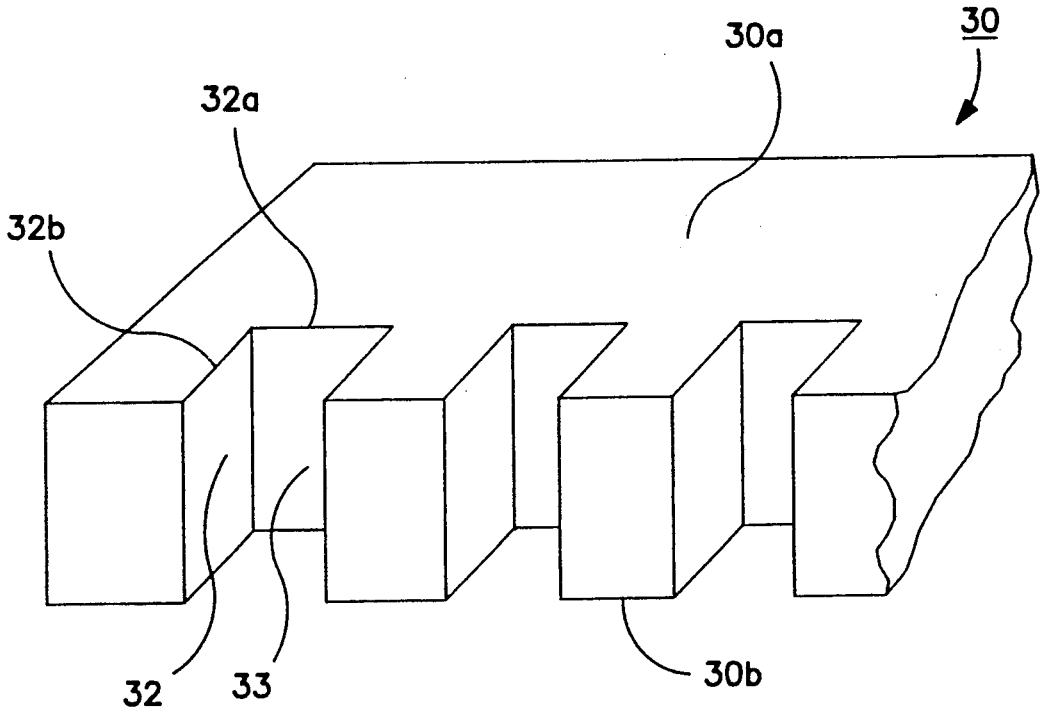
FIG. 3 is a schematic diagram which illustrates the slotted channel member pictured in FIG. 2.

FIG. 2 is a sectional view of the present invention 10 illustrated in FIG. 1. Fluid container 16 has a broad end 18 and a narrow end 20. A volume or pool of liquid 21 resides within fluid chamber 22 between the broad end 18 and the narrow end 20 of fluid container 16. A first chamber surface 24 and a second chamber surface 26 define the width of fluid chamber 22 at both the broad end 18 and the narrow end 20 of fluid container 16. A free liquid surface 27 exists at the narrow end 20 of fluid container 16. An electro-acoustic transducer 28, positioned at broad end 18, generates acoustic pressure waves (not shown) which are essentially normal to the free surface 27 of the contained liquid 21. The fluid chamber cross-section is tapered into the general shape of an acoustic horn to concentrate acoustic pressure waves from the electro-acoustic transducer 28 into the narrow end 20 of the fluid container 16. Electro-acoustic transducer 28 is preferably comprised of individual segments 29 of piezoelectric material to eliminate lateral resonances of the acoustic pressure waves transmitted through the contained liquid 21. However, a single sheet of piezoelectric material, such as PZT, may be alternatively utilized to reduce material costs. A slotted channel member 30 having periodically spaced slots 32 between a top surface 30*a* and a bottom surface 30*b* is positioned at narrow end 20. In a preferred embodiment, slotted channel member 30 has a length which corresponds to the width of a paper projection surface 14, and is composed of single crystal silicon. The slots 32 in member 30 are etched using anisotropic etching (chemical etching) techniques to provide narrow, identical slots with small center-to-center spacings and sharp edges. Alternate embodiments of slotted channel member 30 may utilize molding techniques (in glass or plastic) in which the slots 32 are either etched into a pre-molded glass or plastic bar, or in which the desired pattern of slots 32 are cut directly into the mold. Material selected for the slotted channel member 30 must be chemically inert. Referring to FIG. 3, a schematic diagram which illustrates the slotted channel member 30, top surface 30*a* and bottom surface 30*b*. Slots 32 have a slot width 32*a* which is preferably equal to one-half the center-to-center slot 32 spacings of slotted member 30 (i.e. a 50% spatial duty cycle), and a slot depth 32*b*. Slot back 33 in slotted member 30 extends from top surface 30*a* to bottom surface 30*b*.

Referring back to FIG. 2, a series of piezoelectric pushers 34 are connected to an electronic switch array 36 which is mounting upon the fluid container 16. In a preferred embodiment, apparatus 10 is a highly integrated printhead having a plurality of piezoelectric pushers 34 which are composed of a thin sheet of polyvinylidene flouride (PVDF) polymer and driven by an array of amorphous silicon field-effect transistors 36*a* which are deposited onto a glass substrate 36*b* which is integral to the fluid container 16. The piezoelectric pushers 34 are preferably connected to transistors 36*a* by wirebonds 37. These connections may alternatively be made by hybridizing an array of piezoelectric pushers 34 directly to an array of transistor drivers 36*a* without wirebonds 37. PVDF is a desirable material for this application since it is chemically inert and is capable of relatively large mechanical strains (a displacement of about 25 microns is preferable). Piezoelectric materials other than PVDF, which meet the aforementioned requirements, may be utilized. An alternative embodiment of the present invention integrates an array of discretely addressable piezoelectric pushers 34 with the required transistor switches 36*a* onto a glass substrate 36*b* which is embedded in the body of the fluid reservoir 16 (not shown). A more compact assembly is an objective which is clearly within the scope of the present invention.

Figure 4A:
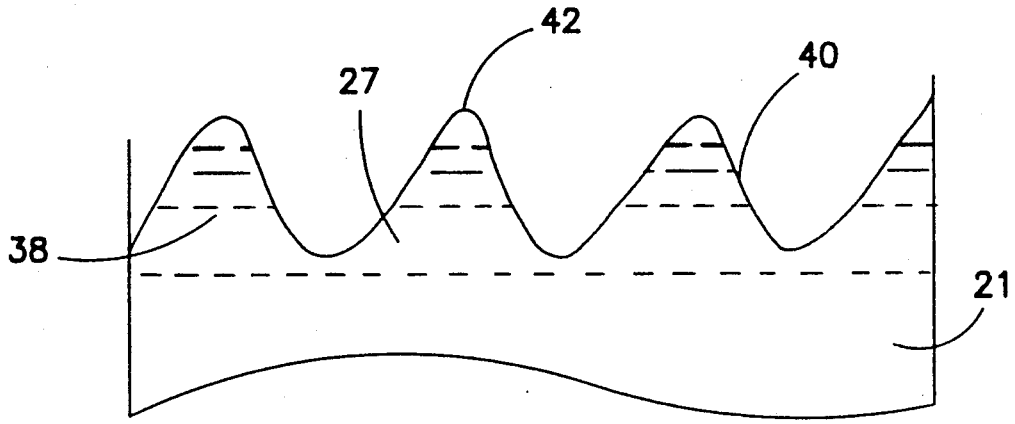
FIGS. 4(*a*) and 4(*b*) are schematic diagrams which illustrate the nodes (anti-nodes) of a capillary wave disturbance on the free surface of a liquid which is spatially stabilized by a slotted member.
Figure 4B:
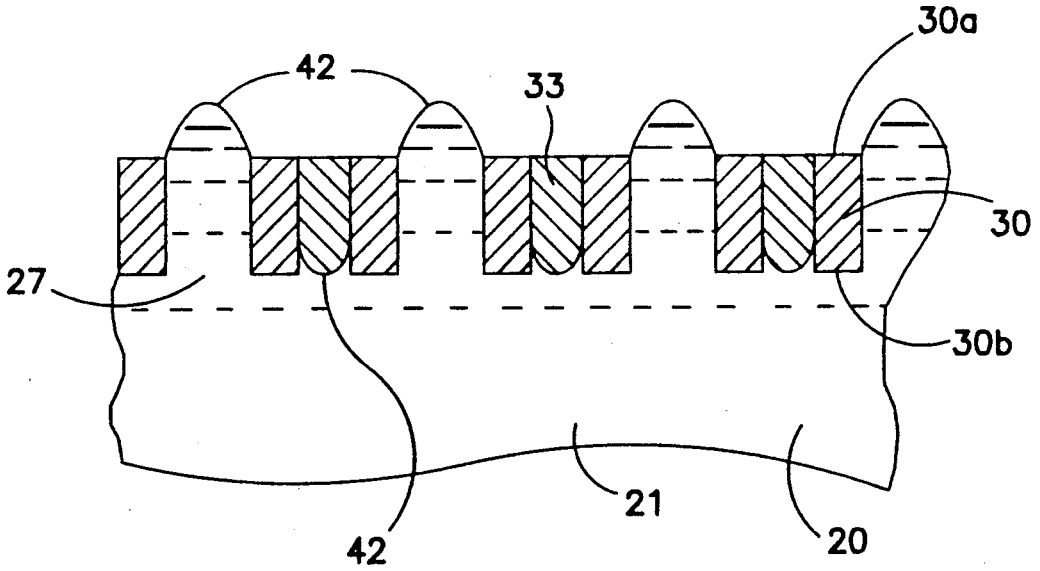

FIG. 4(*a*) is a schematic diagram which illustrates the characteristics of a standing fluid ripple wave 38 (also known as a standing capillary surface wave) which has been parametrically generated upon the free liquid surface 27 at narrow end 20 (not shown). The standing fluid ripple wave 38 is comprised of a plurality of nodes 40 and anti-nodes 42. General and specific discussions pertaining to the generation of capillary surface waves are contained in the aforementioned U.S. Pat. No. 4,719,476 to Elrod et al., dated Jan. 12, 1988, and are readily known to those of ordinary skill in the printing arts. In FIG. 4(*b*), slotted member 30 spatially stabilizes the standing fluid ripple wave 38 by locking alternate nodes 40 and anti-nodes 42 transversly along adjacent slots 32. Dynamically, the anti-nodes 42 crest above the top surface 30*a* of slotted member 30 during one half cycle of the fluid ripple wave 38 oscillation. A complementary spatial relationship of the anti-nodes 42 (a trough rather than a crest) is produced during a second half cycle of the fluid ripple wave 38 oscillation.

Figure 5:
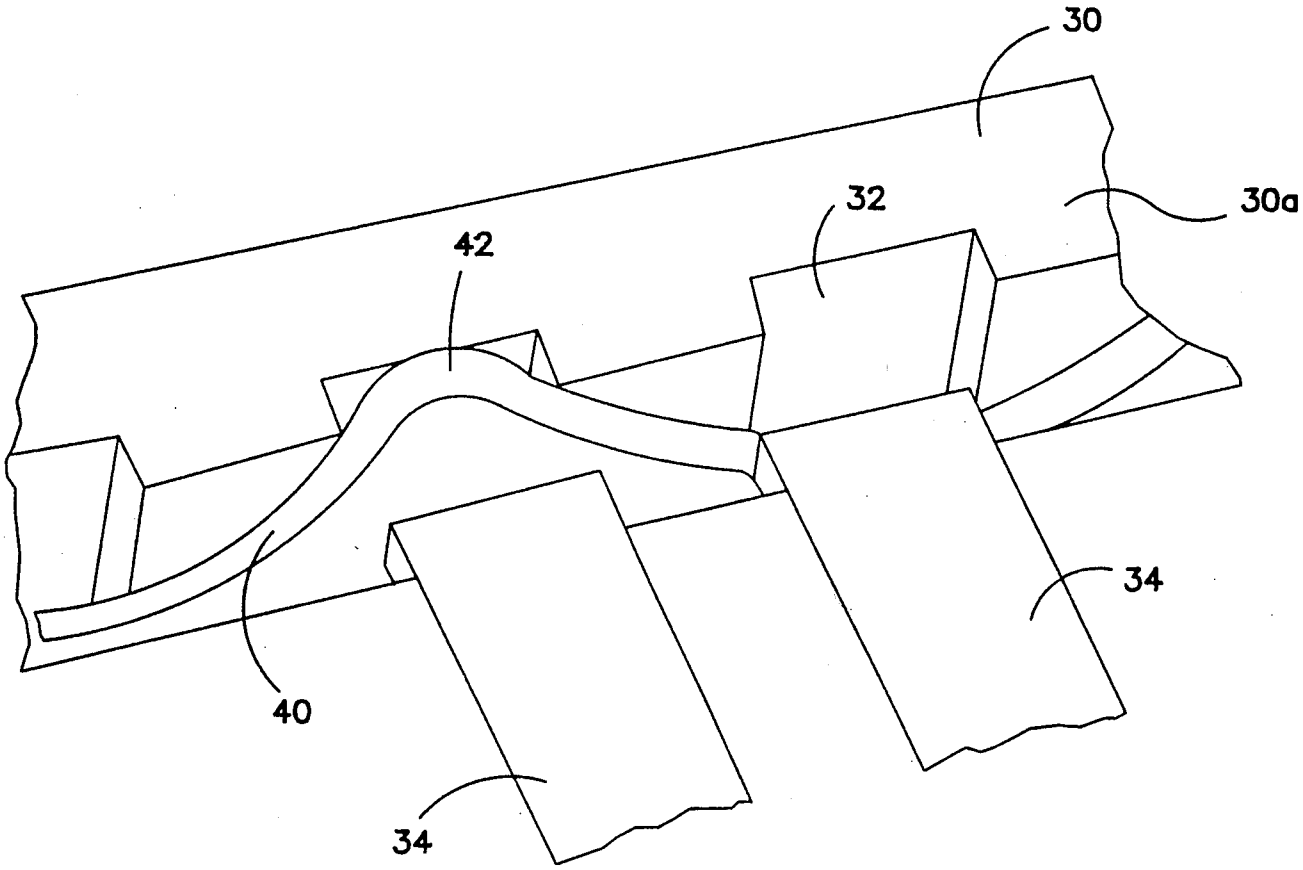
FIG. 5 is a schematic diagram which illustrates the spatial relationship between a retracted piezoelectric pusher and a fluid ripple wave which has been stabilized within a slotted member.
Figure 6:
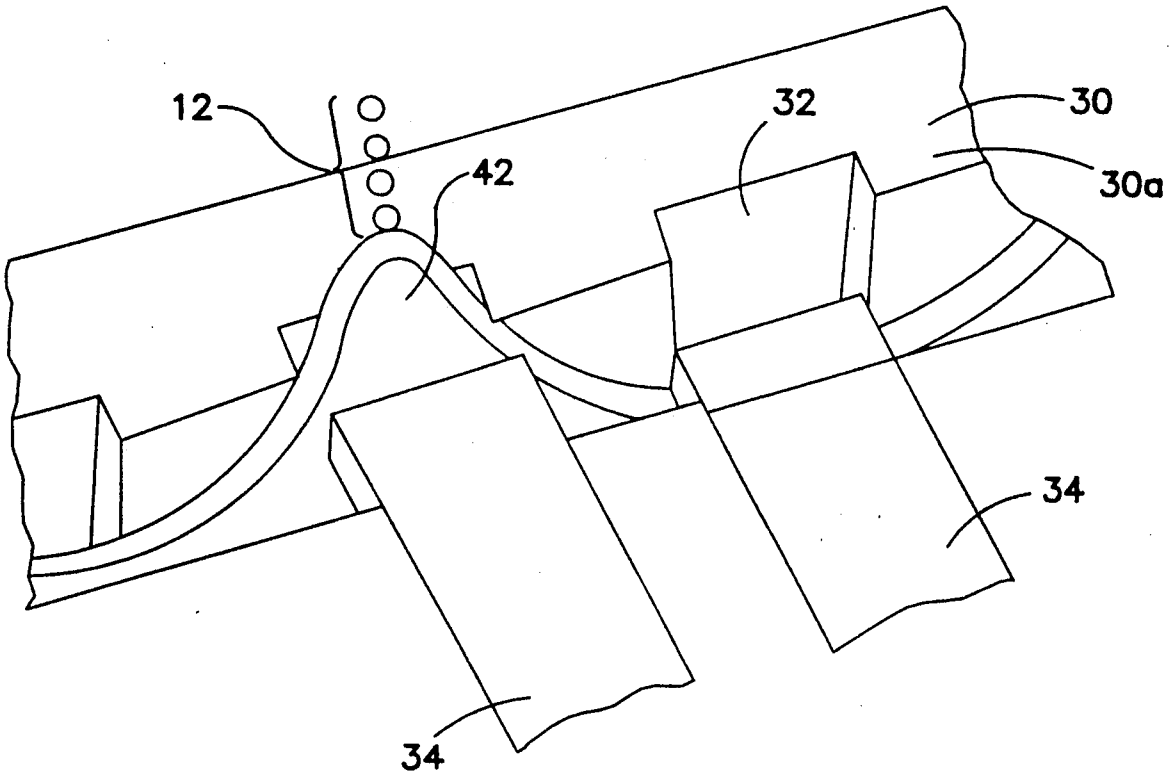
FIG. 6 is a schematic diagrams which illustrates the ejection of droplets from a fluid ripple wave extruded by the extension of a single piezoelectric pusher towards the slotted member shown in FIG. 5.

FIGS. 5 and 6 schematically illustrate the general shape of anti-node 42 both before (FIG. 5) and after (FIG. 6) the projection (or ejection) of a stream of fluid droplets 12. FIG. 5 illustrates the piezoelectric pushers 34 in a retracted position at the time when an anti-node 42 peaks above the top surface 30*a* of slotted member 30. FIG. 6 illustrates the piezoelectric pushers 34 in an extended position at the time when an anti-node 42 peaks above the top surface 30*a* of slotted member 30. The resultant increase in the amplitude of the selected anti-node 42 to a level above the destabilization threshold of the fluid 21 (i.e. a level which overcomes the surface tension of the liquid) accomplishes the ejection of a stream of fluid droplets 12. As is known to those of ordinary skill in the printing art, the selected anti-node(s) 42 may be addressed serially or in parallel, although parallel addressing is preferred for line printing. More importantly, it will be appreciated that the utilization of an array of piezoelectric pushers 34 as a means for ejecting droplets from anti-nodes 42, is superior to currently known addressing mechanisms, since a simple mechanical restriction of a stabilizing slot 32, in which the selected capillary wave peak 42 resides, is all that is required. A slot depth 32*b* of about 25 micrometers is preferred. The mechanical restriction is advantageously implemented by extending the appropriate piezoelectric pusher 34 forward (to restrict the slot depth 32*b*) for a predetermined time interval. This time interval is determined by a controller (not shown) which serves as an interface to a host computer (not shown).

Figure 7:
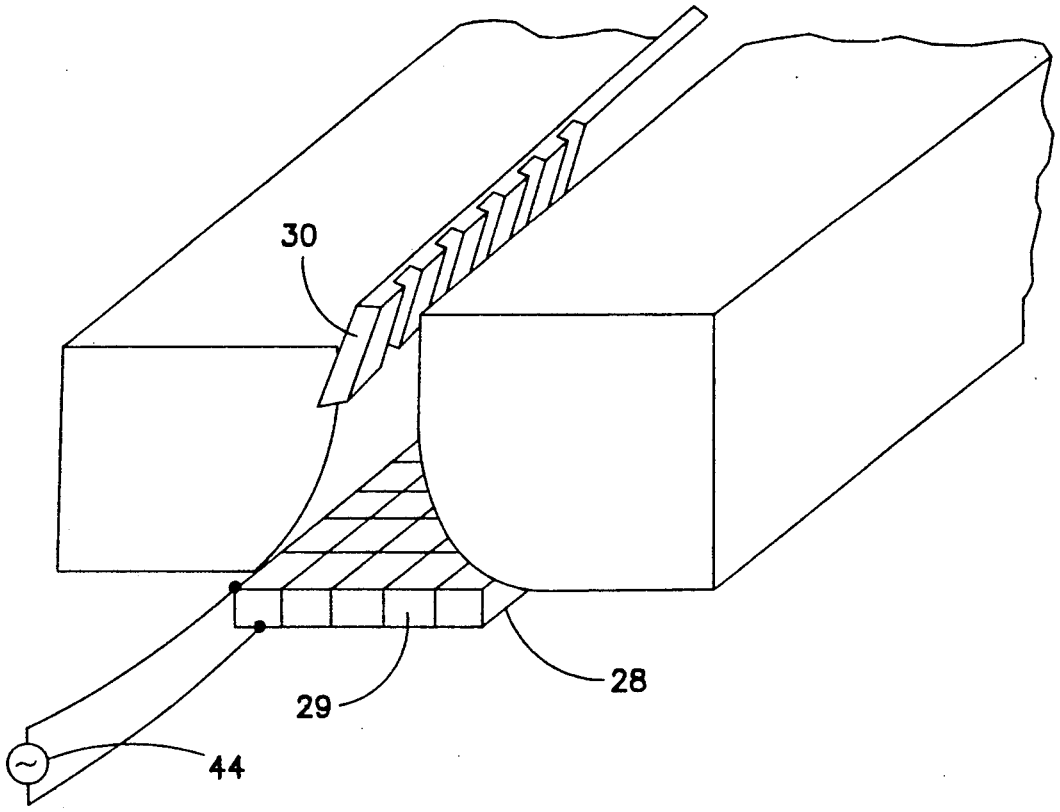
FIG. 7 is a schematic diagram which illustrates the stimulation of the segmented piezoelectric transducer pictured in FIGS. 2 and 7.

FIG. 7 is a schematic diagram illustrating the stimulation of piezoelectric transducer 28 pictured in FIGS. 2 and 7 by a power supply 44 operating at or near RF frequencies. It has been empirically determined that driving the piezoelectric transducer array 28 at an acoustic drive frequency of approximately 50 kilohertz produces a fluid ripple wave 38 having adjacent nodes 40 and anti-nodes 42 separated by approximately 50 micrometers (microns). This empirical finding may easily be supported by theoretical calculation by those familiar with the dynamics of capillary surface waves. The slot depth 32*b* in slotted member 30 is preferably equal to approximately 25 microns, or one-half the wavelength of the standing fluid ripple wave 38 at narrow end 20. The center-to-center spacing of the slots 32 (or pixel pitch) in the slotted member 30 is designed to be approximately 50 microns, or twice the separation between narrow end 20. This spacing between adjacent slots 32 generally yields a pixel pitch of approximately 500 dots per inch. Droplet size may be scaled down (decreasing the pixel pitch) by increasing the acoustic drive frequency to the piezoelectric transducer array 28. This increase in the acoustic drive frequency reduces the nominal standing fluid ripple wave 38 frequency and the required center-to-center slot 32 spacing. The height of the fluid container 16 is tailored to maximize the acoustic pressure at the free surface or the liquid 27 for the acoustic velocity of the selected fluid medium 21 at the operating temperature of the apparatus 10. The acoustic velocity of the selected fluid medium 21 may be easily measured prior to optimizing the height of the fluid container 16 for a selected fluid medium 21.

In a preferred embodiment, the first chamber surface 24 and the second chamber surface 26 of fluid container 16 have an exponentially tapered profile from said broad end 18 to said slot 20. This general shape, which is wide at the broad end 18 of fluid container 16 and narrow at the narrow end 20 of fluid container 16, serves to increase the acoustic intensity generated by piezoelectric tranducer 28 by progressively confining the acoustic pressure waves to a more narrow channel (see Webster, Proc. National Academy of Sciences, Volume 5, 275 (1919)). In an alternate embodiment, the spatial relationship between the first chamber surface 24 and the second chamber surface 26 of fluid container 16 is a linearly tapered profile. This alternate spatial relationship, though not acoustically optimum, is expected to produce acceptable results.

Methods for printing monochromatic or polychromatic image patterns onto a projection surface 14 are within the scope of the present invention. First, the projection surface 14 is brought within a comfortable distance of the apparatus 10 of the present invention. In a preferred embodiment, this distance is approximately 200 to 300 microns. The projection surface 14 is then transported across the apparatus 10 at a generally constant velocity. In a preferred embodiment, this velocity results in the printing of approximately one 8.5" by 11" sheet of paper every two (2) seconds. In order to transfer a graphic image to paper, electronic switch array 36 is commanded to drive the appropriate piezoelectric pushers 34 for an appropriate length of time to project the desired number of fluid droplets in the fluid stream 12 corresponding to the monochromatic intensity of each picture element in the graphic image. The capability to reproduce a monochromatic pseudo-gray-scale (by variable spot-size modulation) is thus provided by modulating the electrical stimulation to each switch in the electronic switch array 36 which drives the array of piezoelectric pushers 34. These methods may be extended to produce polychromatic images by providing one apparatus 10 for each color to be printed arranged to scan the projection surface 14 in parallel scan format (not shown). An integrated apparatus (not shown) having three or four color heads may be driven in parallel to maximize the speed of one-pass full color printing.

Although the present invention has been described in detail with reference to a particular preferred embodiment, persons possessing ordinary skill in the art to which this invention pertains will appreciate that various modifications and enhancements may be made without departing from the spirit and scope of the claims that follow.

LIST OF REFERENCE NUMERALS

FIG. 1

10 Apparatus of the present invention
12 Stream of fluid droplets
14 Projection surface

FIGS. 2 and 3

16 Fluid container
18 Broad end of fluid container
20 Narrow end of fluid container
21 Volume of fluid
22 Fluid chamber
24 First chamber surface
26 Second chamber surface
27 Free surface of fluid
28 Electro-acoustic transducer
29 Transducer segment
30 Slotted member
**30*a*** Top surface of slotted channel member
**30*b*** Bottom surface of slotted channel member
32 Slot
**32*a*** Slot width
**32*b*** Slot depth
33 Slot back
34 Piezoelectric pusher
36 Electronic switch array
**36*a*** Amorphous silicon transistor switches
**36*b*** Glass substrate
37 Wirebond

FIGS. 4, 5 and 6

38 Fluid ripple wave
40 Node
42 Anti-node

FIG. 7

44 Power supply

What is claimed is:

1. In a capillary wave printer including a fluid filled container (16) having a broad end (18), a narrow end (20), a first chamber surface (24) and a second chamber surface (26); said first chamber (24) surface generally facing said second chamber surface (26) and said broad end (18) opposing said narrow end (20); a power supply (44); an electro-acoustic transducer (28) in communication with said broad end (18); said electro-acoustic transducer (28) being connected to said power supply (44); an apparatus (10) comprising:

a slotted channel member (30) in communication with said narrow end (20) of said fluid filled container (16), said slotted channel member (30) having a top surface (**30*a*) and a bottom surface (30*b***);

said slotted channel member (30) having a plurality of periodically spaced slots (32) disposed between said top surface (**30*a*) and said bottom surface (30*b***);

a plurality of piezoelectric pushers (34) in communication with said fluid filled container (16) at said narrow end (20) and defining a distance between each one of said plurality of piezoelectric pushers and each one of said plurality of periodically spaced slots; said plurality of piezoelectric pushers (34) corresponding to and being adjacently disposed to said plurality of periodically spaced slots (32); said plurality of piezoelectric pushers (34) being capable of varying the distance between said plurality of piezoelectric pushers (34) and said plurality of periodically spaced slots (32);

a plurality of electronic switches (36) for selectively stimulating each of said plurality of piezoelectric pushers (34), said plurality of electronic switches (36) being connected to said fluid filled container (16);

said plurality of electronic switches (36) in electrical communication with each of said piezoelectric pushers (34); and whereby selective stimulation of said plurality of piezoelectric pushers (34) by said plurality of electronic switches (36) alters the distance between said plurality of periodically spaced slots (32) and said plurality of piezoelectric pushers (34) to change level of energy per unit area defined by separation between said plurality of piezoelectric pushers (34) and said plurality of periodically spaced slots (32) to better control size of droplets of ink ejected from said fluid filled container (16).

2. An apparatus (10) as claimed in claim 1 further comprising a plurality of wirebonds (37), said plurality of wirebonds (37) electrically disposed between said plurality of electronic switches (36) and said plurality of piezoelectric pushers (34).

3. An apparatus (10) as claimed in claim 1 in which said electro-acoustic transducer (28) is composed of a plurality of transducer segments (29).

4. An apparatus (10) as claimed in claim 3 in which said transducer segments (29) are composed of piezoelectric material.

5. An apparatus (10) as claimed in claim 1, in which said slots (32) are anisotropically etched into a single crystal silicon substrate.

6. An apparatus (10) as claimed in claim 1, in which said slots (32) are etched into a molded glass substrate.

7. An appararus (10) as claimed in claim 1, in which said slots (32) are etched into a molded plastic substrate.

8. An apparatus (10) as claimed in claim 1, in which said slotted member (30) having said slots (32) is molded in glass.

9. An apparatus (10) as claimed in claim 1, in which said slotted member (30) having said slots (32) is molded in plastic.

10. An apparatus (10) as claimed in claim 1, in which said plurality of piezoelectric pushers (34) are composed of a piezoelectricc material.

11. An apparatus (10) as claimed in claim 10, in which said plurality of piezoelectric pushers (34) are composed of a thin sheet of polyvinylidene fluoride (PVDF) polymer.

12. An apparatus (10) as claimed in claim 1, in which said plurality of electronic switches (36) includes a monolithic array of amorphous silicon transistors switches (**36*a*) integrated onto a glass substrate (36*b***).

13. An apparatus (10) as claimed in claim 12, in which said monolithic array of amorphous silicon transistor switches (**36*a*) and said plurality of piezoelectric pushers (34) are integrated onto said glass substrate (37**).

* * * * *